US007108458B1

(12) United States Patent
Davie, Jr. et al.

(10) Patent No.: US 7,108,458 B1
(45) Date of Patent: Sep. 19, 2006

(54) INTERLOCKING SLAB LEVELING SYSTEM

(75) Inventors: Warren P. Davie, Jr., 718 Carmenere Dr., Kenner, LA (US) 70065; James A. Gillen, Metairie, LA (US)

(73) Assignee: Warren P. Davie, Jr., Kenner, LA (US)

( * ) Notice: Subject to any disclaimer, the term of this patent is extended or adjusted under 35 U.S.C. 154(b) by 0 days.

(21) Appl. No.: 11/049,356

(22) Filed: Feb. 1, 2005

Related U.S. Application Data

(62) Division of application No. 10/011,678, filed on Dec. 4, 2001, now Pat. No. 6,848,864.

(60) Provisional application No. 60/277,573, filed on Mar. 21, 2001.

(51) Int. Cl.
*E02D 27/48* (2006.01)
*E02D 5/30* (2006.01)

(52) U.S. Cl. ..... 405/230; 405/251; 405/252

(58) Field of Classification Search ..... 405/230, 405/251, 252, 231, 232
See application file for complete search history.

(56) References Cited

U.S. PATENT DOCUMENTS

| | | | |
|---|---|---|---|
| 2,065,507 | A | 12/1936 | Alexander |
| 2,187,677 | A | 1/1940 | Brumley |
| 2,351,288 | A | 6/1944 | Riches |
| 3,382,680 | A | 5/1968 | Takano |
| 3,593,532 | A | 7/1971 | Grazel |
| 3,625,012 | A | 12/1971 | Thorburn |
| 3,748,863 | A | 7/1973 | Pogonowski et al. |
| 3,884,589 | A | 5/1975 | Liedholm |
| 4,157,230 | A | 6/1979 | Tomt et al. |
| 4,604,003 | A | 8/1986 | Francoeur et al. |
| 4,605,340 | A | 8/1986 | Stephan |
| 4,627,769 | A | 12/1986 | Lee |
| 4,668,119 | A | 5/1987 | Galletti |
| 4,735,527 | A | 4/1988 | Bullivant |
| 4,836,717 | A | 6/1989 | Landaeus et al. |
| 5,096,333 | A | 3/1992 | Bassett |
| 5,288,175 | A | 2/1994 | Knight |
| 5,320,453 | A | 6/1994 | Bullivant |
| 5,399,055 | A | 3/1995 | Dutton, Jr. |
| 5,505,561 | A | 4/1996 | Willcox, III |
| 5,531,544 | A | 7/1996 | Willcox, II |
| 5,713,701 | A | 2/1998 | Marshall |
| 6,200,070 | B1 | 3/2001 | Knight |

FOREIGN PATENT DOCUMENTS

| | | |
|---|---|---|
| GB | 2280466 | 2/1995 |
| JP | 62-194320 | 8/1987 |
| JP | 62-273318 | 11/1987 |
| JP | 6-73991 | 3/1994 |

OTHER PUBLICATIONS

Printout from Web page of Meadow Burk for "Coil Hanger Saddle" and "Adjustable Screed Cahirs", Mar. 16, 2001.

*Primary Examiner*—Sunil Singh
(74) *Attorney, Agent, or Firm*—Garvey, Smith, Nehrbass & North, L.L.C.; Brett A. North

(57) ABSTRACT

A method and apparatus for repairing building foundations by segmented underpinning. More specifically, the a method and apparatus is provided for repairing building foundations using interlocking segmented underpinning piles which are reinforced in a longitudinal direction.

14 Claims, 8 Drawing Sheets

INTERLOCKING SLAB LEVELING SYSTEM

CROSS-REFERENCE TO RELATED APPLICATIONS

This is a divisional application of U.S. patent application Ser. No. 10/011,678, filed 4 Dec. 2001, now U.S. Pat. No. 6,848,864 priority of which is hereby claimed, and wherein said application is incorporated herein by reference.

Priority of U.S. Provisional Patent Application Ser. No. 60/277,573, filed 21 Mar. 2001, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the repair of building foundations by underpinning. More specifically, the present invention relates to an interlocking slab leveling system using longitudinally reinforced segmented underpinning pilings.

2. General Background of the Invention

Most conventionally available leveling systems use segmented underpinning pilings comprised of vertically stacked, unconnected, precast concrete segments. These segments are pressed or driven vertically into the soil one at a time until an adequate load capacity is obtained. Segmented underpinning pilings are useful because they can be installed with minimal clearance underneath an existing foundation which is to be leveled.

Although serviceable, these segmented underpinning pilings have various disadvantages, which include, but are not limited to: (a) pile segments being not aligned, other than being stacked one on top of each other allowing for problematic misalignments and (b) completed underpinning pilings being unreinforced stacks of precast concrete segments. Misalignment of segments during installation can produce several problematic conditions related to pile stability.

Non-interlocked segmented underpinning pilings can separate at segment joints or fail at segment midpoints where dynamic soil conditions create transient longitudinal or tensile stresses, such as in clay soils having high shrink-swell potentials. Separation of segments can occur when clay soils swell after an increase in moisture content where the soil swell exposes the segmented pile to tension forces in a longitudinal direction.

These transient longitudinal stresses are detrimental to non-interlocked segmented underpinning pilings because they can create gaps between the piling segments. Even a slight gap between two segments allows for soil intrusion between the two segments and prevents closing of the gap when soil moisture decreases. Each time a new swell cycle is found the gap can be increased allowing for additional soil intrusion. Each joint between the various segments can experience this phenomenon. Over a period of years, cyclical shrink-swell effect can lift the upper portion of the segmented underpinning pile and the supported structure creating a new non-leveled condition.

A second type of segmented piling system is described in U.S. Pat. No. 5,288,175 which describes a segmental precast concrete underpinning pile using a continuous high strength strand for longitudinally reinforcing the various the precast segments which strand is bonded or anchored upon completion. This type of piling is more labor intensive to install than the present invention in requiring monitoring of the placement of the individual segments, threading of the strand, and placement of the bonding agent. Areas with high water tables can circumvent the use of a bonding agent as the water comes in contact with the agent. Furthermore, the steel strand can relax over time reducing the amount of longitudinal reinforcement. Additionally, if the strand fails due to corrosion or for some other reason the entire pile becomes an unreinforced segmented pile with the above described disadvantages.

The following U.S. patents are incorporated herein by reference: U.S. Pat. No. 5,288,175.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY OF THE INVENTION

The apparatus of the present invention solves the problems confronted in the art in a simple and straightforward manner. What is provided is a method and apparatus for repairing building foundations by segmented underpinning. More specifically, the present invention provides a method and apparatus for repairing building foundations using interlocking segmented underpinning piles which are reinforced in a longitudinal direction.

In a preferred embodiment, the invention incorporates a precast starter segment with a coil embedded in one end of the segment, and a coil rod protruding from the other end. This starter segment is driven into the soil with its protruding rod end facing downwards. A second segment is next interlocked with the first by threading the second segment's rod end into the coil end of the starter segment. The second segment is screwed into the first until the two lock. The segmented underpinning piling is then further driven into the ground with the second segment.

The above procedure is repeated for third, fourth, and additional segments until sufficient load capacity and depth are obtained for the underpinning piling. The process ultimately creates an interlocked segmented underpinning piling reinforced in the longitudinal direction.

In a preferred embodiment, the method and apparatus of a preferred embodiment of the present invention provides a longitudinally aligned, interlocked, and longitudinally reinforced, segmented underpinning piling. The segmented underpinning piling can be installed with minimal clearance underneath an existing structure.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
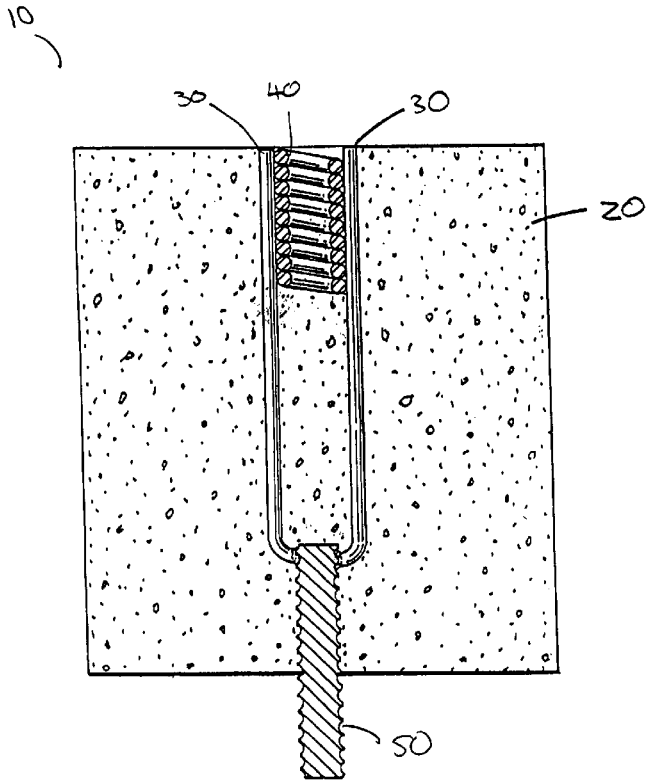
FIG. 1 is sectional view of a pile section in a preferred embodiment of the apparatus of the present invention.
Figure 2:
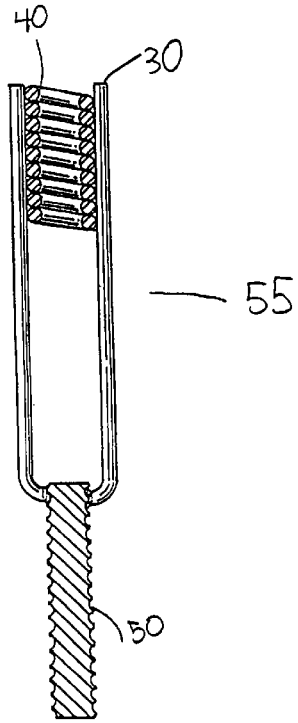
FIG. 2 is a section view of a upper coil, bars, and rod in a preferred embodiment of the apparatus of the present invention.
Figure 10:
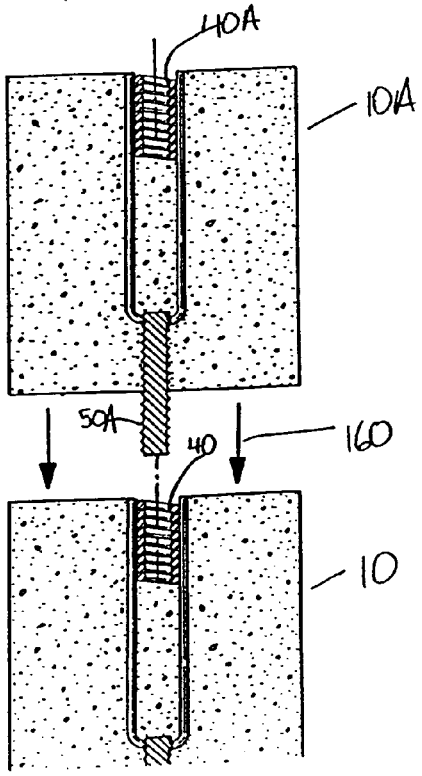
FIG. 10 shows a second pile segment being attached to the starter pile segment.

FIG. 1 is sectional view of a pile section 10 in a preferred embodiment of the apparatus of the present invention. The segment body 20 can be made of concrete or other structural material having good compressive strength. It preferably has a circular cross section of approximately 6 to 14 inches in diameter and is 6 to 14 inches in height. However, its cross-section can be of different or varying shapes without substantially impacting the effectiveness of each segment's bearing capacity. As shown in FIG. 2, the segment body 20 includes two bars 30, coil 40, and rod 50. The two bars 30 can be attached to the coil 40 and rod 50 by various conventionally means such as welding. The pitch of the threads for the coil 40 and rod 50 should match and should be course enough to avoid seizure even if particles of soil become lodged inside said threads. One thread which has worked is adapted (as shown in FIGS. 1, 2, and 10) from the coil rod, coil hangers, and/or screed chairs manufactured by Meadow Burke (www.meadowburke.com). The two bars 30, coil 40, and rod 50 form interlocking unit 55. Interlocking unit 55 can be prefabricated and then integrally cast with segment body 20. Preferably interlocking unit 55 is placed in the center of the cross section of segment body 20 along the body's longitudinal axis. Placing interlocking unit 55 in the center facilitates easy installation of various pile segments along a single longitudinal axis.

Figure 3:
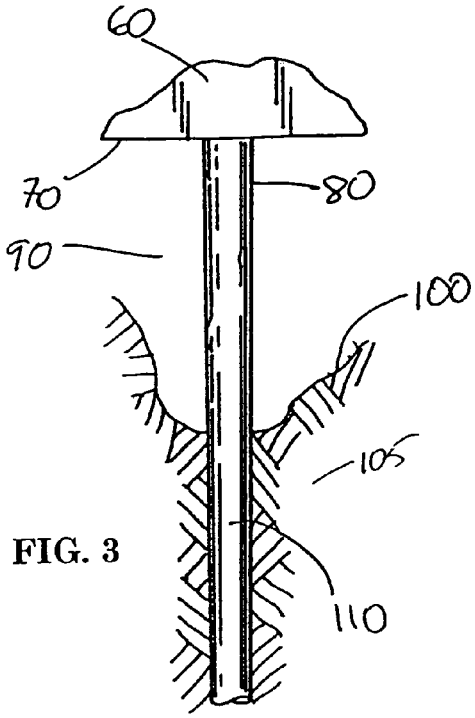
FIG. 3 shows an excavated area under a building slab which is supported by a wooden piling.
Figure 4:
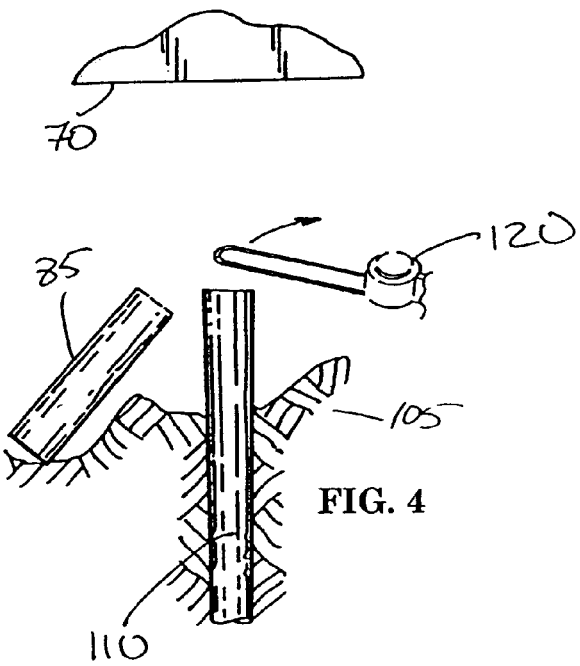
FIG. 4 shows the upper portion of the wooden piling being removed.
Figure 5:
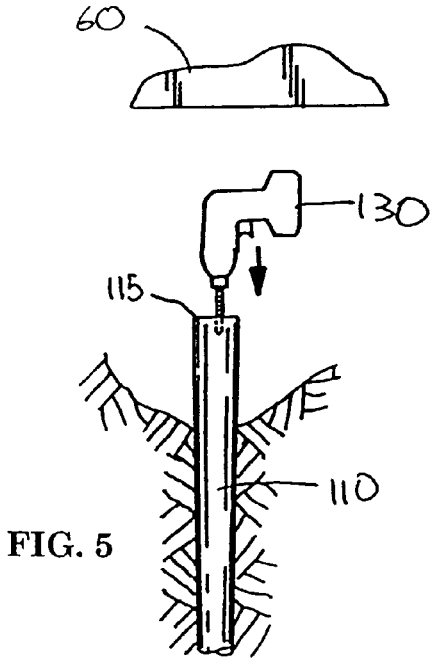
FIG. 5 shows the top of the lower portion of the wooden piling being drilled.

FIGS. 3 through 15 show various steps for installing a segmented piling on top of an existing wooden piling. As shown in FIG. 3 an excavated area 90 under the building slab 60 and around the upper portion 80 of the wooden piling is made. FIG. 4 shows the upper portion 80 of the wooden piling being removed by a saw 120. The lower portion 110 of the wooden piling remains in the subsoil 105. FIG. 5 shows the top 115 of the lower portion 110 of the wooden piling being drilled by drill 130 to form bore 116.

Figure 6:
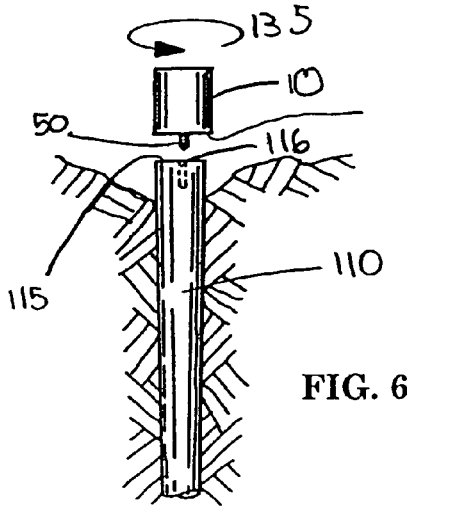
FIG. 6 shows a starter pile segment being attached to the top of the lower portion of the wooden piling.
Figure 7:
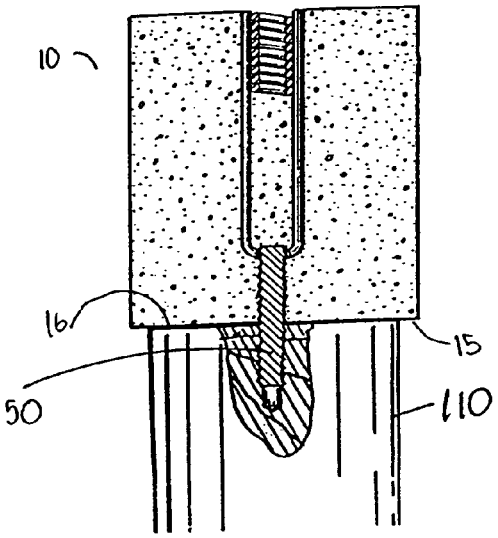
FIG. 7 is a sectional view of FIG. 6 showing the starter pile segment attached to the top of the lower portion of the wooden piling.

FIG. 6 shows a starter pile segment 10 being attached to the top 115 of the lower portion of the wooden piling. The starter pile segment 10 is turned in the direction of arrow 135 while downward pressured is placed. Rod 50 will threadably lock with the lower section 110 of wooden piling through bore 116. FIG. 7 is a sectional view of FIG. 6 showing the starter pile segment 10 attached to the top of lower portion 110 of the wooden piling. The threads of rod 50 are interlocked with the wooden piling and the bottom surface 15 of segment 10 is touching the top surface 16 of wooden piling. Thus, the segment 10 and wooden piling can become interlocked.

Figure 8:
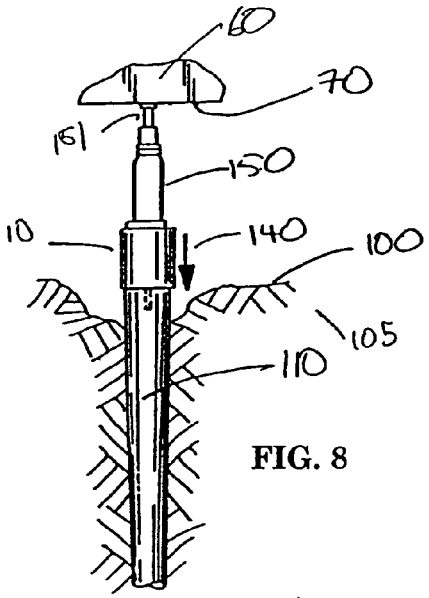
FIG. 8 shows a jack being used to push the starter pile segment and wooden piling into the soil.
Figure 9:
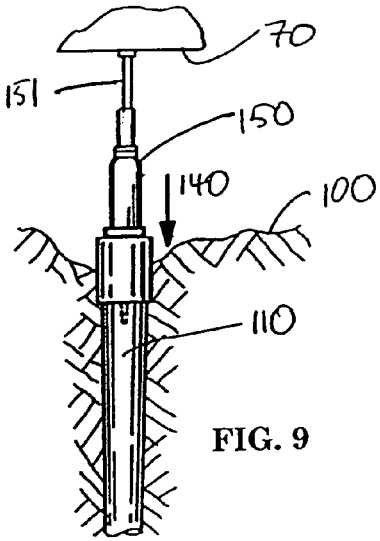
FIG. 9 shows the jack of FIG. 8 after the starter pile segment and wooden piling have been pushed down into the soil.

FIG. 8 shows jack 150 being used to push starter pile segment 10 and wooden piling into soil 105 in the direction of arrow 140. The downward pushing force is created by the weight of the building slab 60 as jack arm 151 is raised. FIG. 9 shows jack 120 having been pushed down into soil 105 (in the direction of arrow 140) both starter pile segment 10 and wooden piling where jack arm 151 is in a raised condition. Downward movement is achieved where the reactionary force from the building slab 60 transferred through jack arm 151 exceeds the combined frictional forces created by soil 105 against the lower portion 110 of the wooden piling. Jack 150 is now removed so that another segmented piling 10 can be installed.

Figure 15:
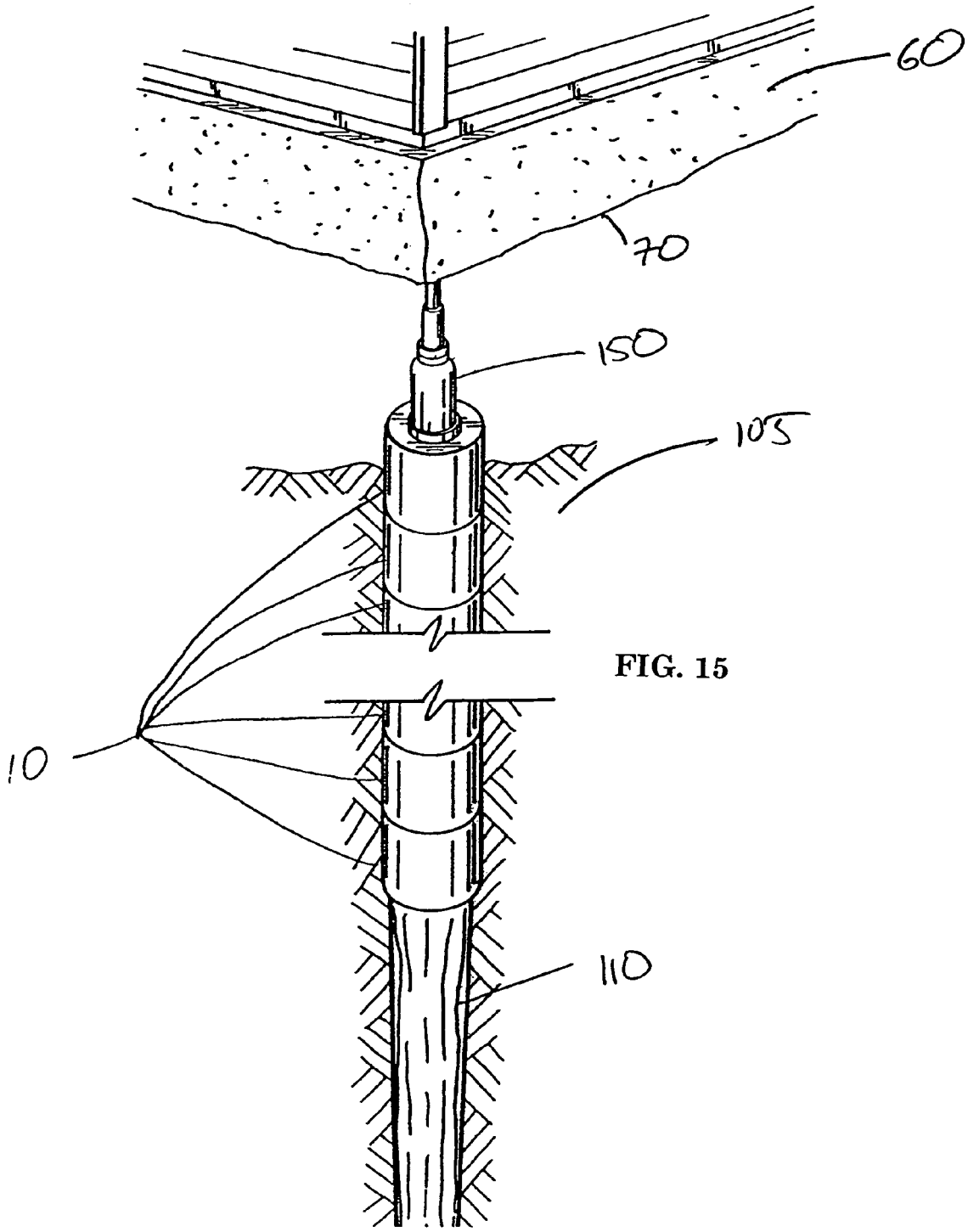
FIG. 15 shows a sectional and perspective view of a preferred embodiment of the apparatus of the present invention after several pile segments and the wooden piling have been pushed into the soil.

FIG. 10 shows a second pile segment 10A being attached to the starter pile segment 10. Rod 50A of pile segment 10A threadably engages coil 40 of pile segment 10. Pile segment 10A is turned until its lower surface engages the upper surface of pile segment 10. Thus, pile segment 10A and pile segment 10 become interlocked with each other. Jack 150 is placed on top of pile segment 10A and the previously described process of jacking and pushing down is repeated until pile segment 10A, pile segment 10, and wooden piling have been pushed down into soil 105 in the direction of arrow 140. Jack 150 is then again removed. FIG. 15 shows a perspective view of a preferred embodiment of the apparatus of the present invention after several pile segments 10 and the lower portion 110 of the wooden piling have been pushed into soil 105. Building slab 60 is supported by jack 150 which is supported on the uppermost pile segment 10.

Figure 11:
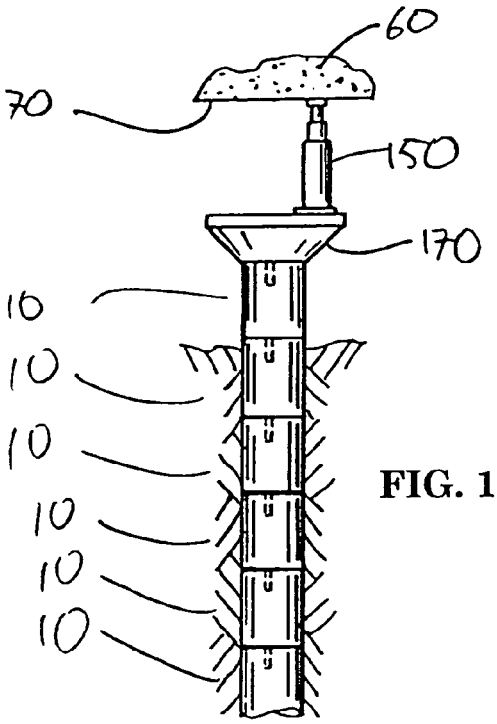
FIG. 11 shows the jack supporting the slab after several pile segments have been pushed into the soil.

Additional pile segments can be installed using similar procedures until the frictional forces from the soil 105 on the lower section 110 of the wooden piling until all segmented pile sections 10 reach a point where jack 150 can actually lift building slab 60 instead of further pushing down the segmented piling. Piling cap 170 is then installed on top of the uppermost segmented pile 10. This point is shown in FIG. 11 where jack 150 is supporting slab 60 after several pile segments 10 have been pushed into soil 105. The lower portion 110 of the wooden piling is below the numerous segmented pile sections 10.

Figure 12:
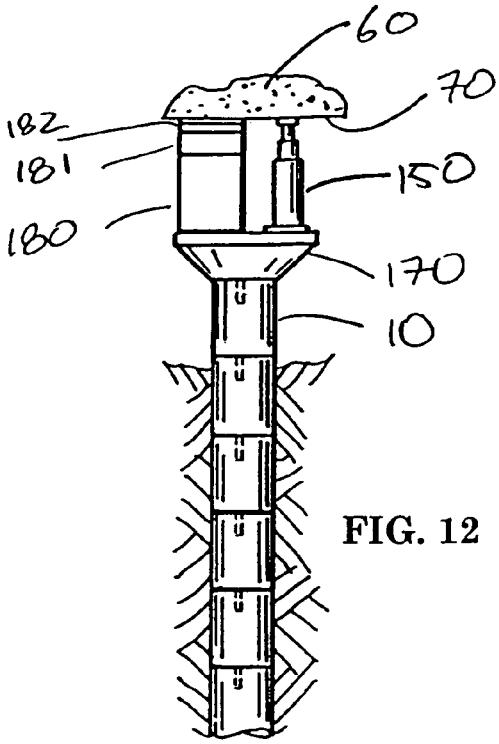
FIG. 12 shows a block being placed on top of the piling cap while the jack is supporting the building slab after several pile segments have been pushed into the soil.
Figure 13:
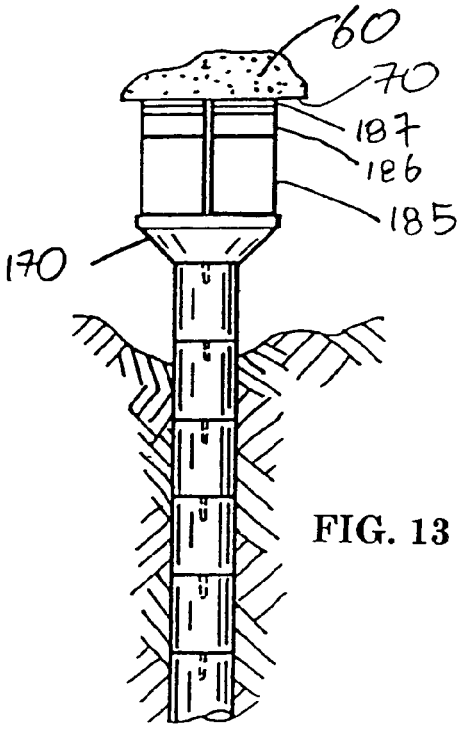
FIG. 13 shows two blocks supporting the building slab after several pile segments have been pushed into the soil.

FIG. 12 shows a block 180 and shims 181, 182 placed on top of piling cap 170 while the jack 150 is supporting the building slab 60 after several pile segments 10 have been pushed into the soil 105. Ultimately, building slab 60 will rest on block 180 and shims 181, 182. Shims 181, 182 should be selected to ensure proper height of the bottom 70 of building slab 60. FIG. 13 shows two blocks supporting building slab 60 after several pile segments 10 have been pushed into soil 105. A second block 185 and second set of shims 186, 187 are inserted between pile cap 170 and building slab 60.

Figure 14:
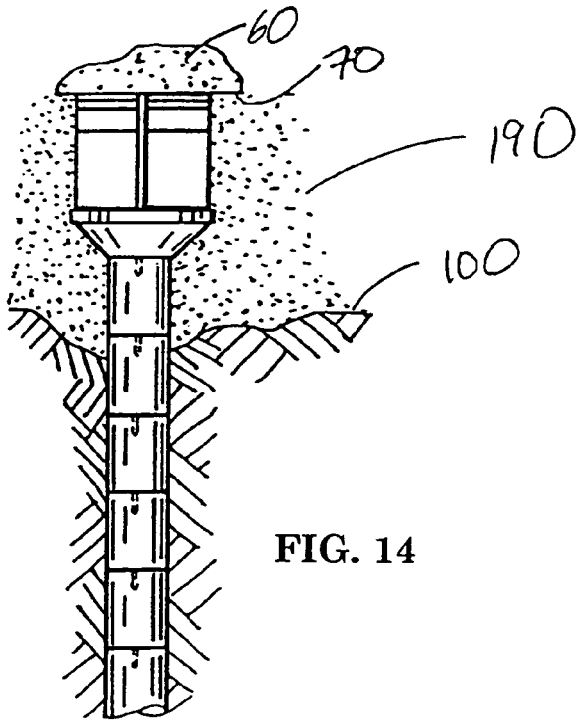
FIG. 14 shows backfill filling the excavated space under the slab.

FIG. 14 shows backfill 190 filling the excavated space 90 under building slab 60. The backfill 190 can be sand or other fill compatible with soil 105. Preferably, the backfill should be self-compacting to minimize possible subsidence.

The above described process has included a wooden piling. However, the segmented piling blocks 10 can be used by themselves without wooden pilings.

Figure 16:
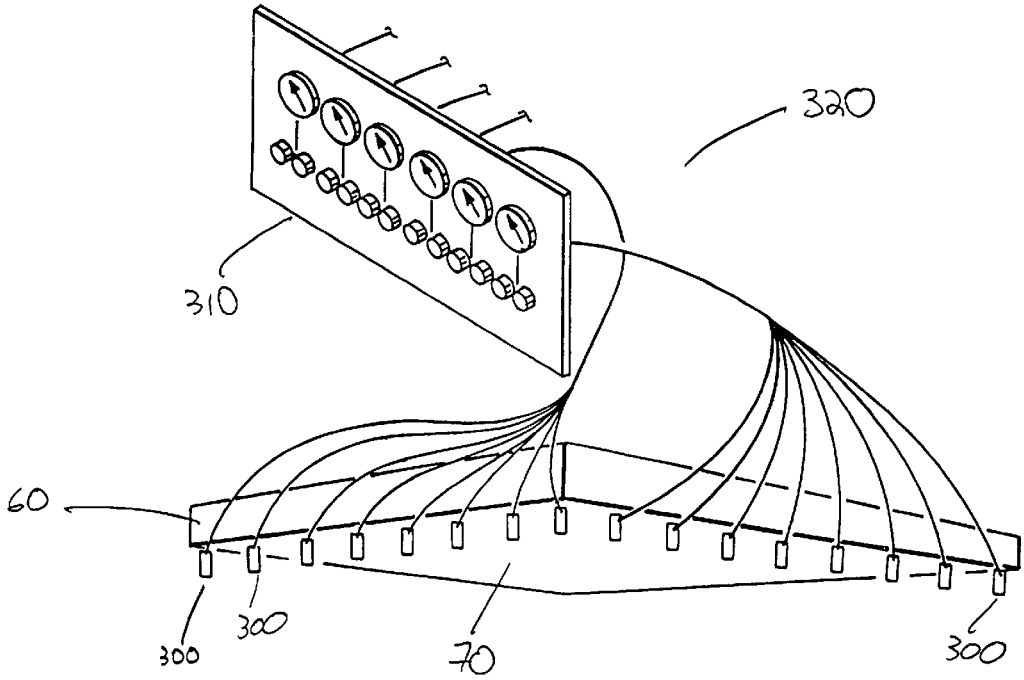
FIG. 16 shows a perspective view of a control system for simultaneously operating a series of hydraulic jacks for controlling the lift of a defined area of the building slab.

FIG. 16 shows a perspective view of a conventionally available control system 320 for simultaneously operating a series of hydraulic jacks 300 for controlling lift of a defined area of building slab 60. Use of control system 320 minimizes the risk that slab 60 will crack due to differential forces created by the set of jacks 300. Using individual jacks risks differentially raising the slab and creating stress cracks. Using control system 320 allows numerous segmented piles to be simultaneously pushed into soil 105.

Figure 17:
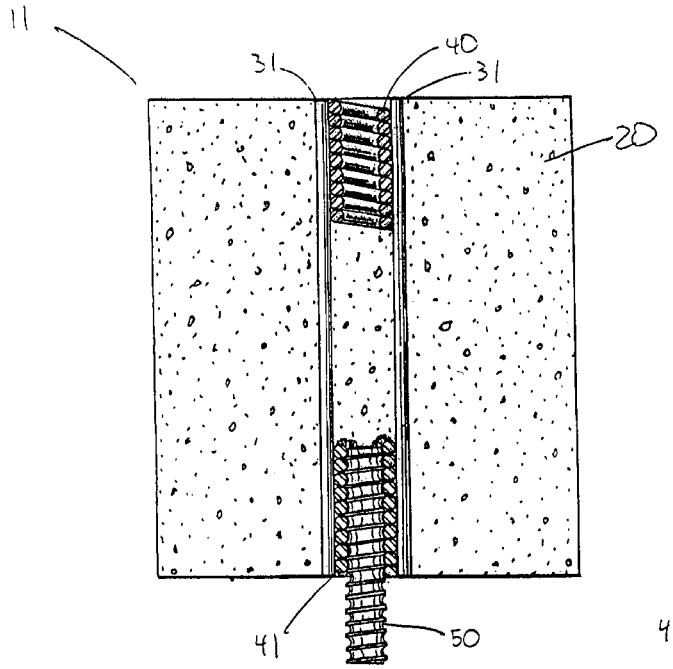
FIG. 17 is sectional view of an alternative embodiment for a pile section in a preferred embodiment of the apparatus of the present invention.

FIG. 17 is sectional view of an alternative embodiment for a pile section 11 in a preferred embodiment of the apparatus of the present invention. The segment body 20 can be made of concrete or other structural material having good compressive strength. It preferably has a circular cross section of approximately 6 to 14 inches in diameter and is 6 to 14 inches in height. However, its cross-section can be of different and varying shapes without substantially impacting the effectiveness of each segment's bearing capacity. The segment body 20 includes two bars 31 which substantially extend throughout the height of block 20. Also included are upper coil 40 and lower coil 41. Rod 50 is threadably attached by lower coil 41 and can be permanently welded or attached by some other conventional means.

Figure 18:
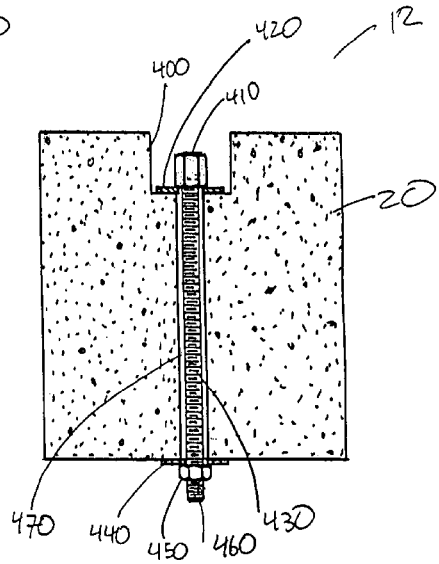
FIG. 18 is sectional view of a second alternative embodiment for a pile section in a preferred embodiment of the apparatus of the present invention.
Figure 19:
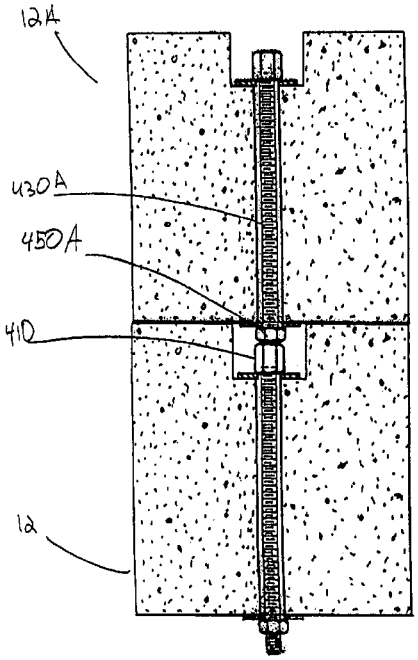
FIG. 19 shows two pile sections interlocked in a second alternative embodiment.
Figure 20:
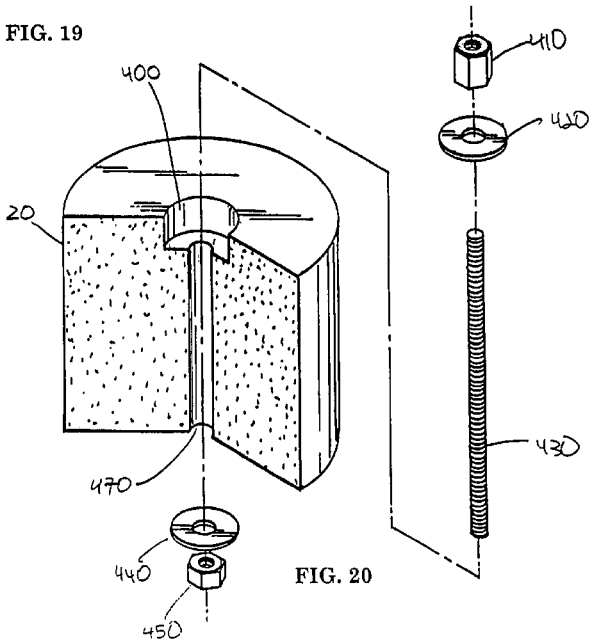
FIG. 20 shows an exploded view of a second alternative embodiment.

FIGS. 18 and 20 show sectional views of a second alternative embodiment for a pile section 12 in a preferred embodiment of the apparatus of the present invention. The segment body 20 can be made of concrete or other structural material having good compressive strength. It preferably has a circular cross section of approximately 6 to 14 inches in diameter and is 6 to 14 inches in height. However, its cross-section can be of different and varying shapes without substantially impacting the effectiveness of each segment's bearing capacity. The segment body 20 includes a recessed space 400 and longitudinal bore 470. A threaded rod 430 is placed in longitudinal bore 470. Upper washer 420 is placed in recessed spaced 400 over threaded rod 430. Nut 410 is threaded onto the top portion of threaded rod 430 in recessed space 400. Lower washer 440 is placed over the lower portion of threaded rod 430 and nut 450 used to secure threaded rod 430 into block 20. Nut 410 is installed on rod 430 such that it has adequate threads above the top of rod 430 to accept a second rod. The bottom of rod 460 has adequate threads protruding through nut 450 so that it can threadably engage a nut 410 on a second block 12. Nuts 410 and 450 can be torqued down on block 20 to prevent rotational slippage of rod 430. FIG. 19 shows two pile sections 12 and 12A interlocked in a second alternative embodiment. The portion of rod 430A protruding through nut 450 threadably engages nut 410. Thus sections 12 and 12A become interlocked.

PARTS LIST

The following is a list of parts and materials suitable for use in the present invention:

| Reference Numeral | Description |
|---|---|
| 10 | pile segment of a preferred embodiment of the present invention |
| 10A | second pile segment |
| 11 | pile segment for an alternative embodiment |
| 12 | pile segment for a second alternative embodiment |
| 12A | second pile segment for second alternative embodiment |
| 15 | bottom surface of pile section |
| 16 | top surface of wooden piling |
| 20 | segment body (concrete or other structural material) |
| 30 | bar (steel, copper, aluminum or other structural material) |
| 31 | bar (steel, copper, aluminum or other structural material) |
| 40 | upper coil |
| 40A | upper coil in second pile segment |
| 41 | lower coil |
| 50 | rod |
| 50A | rod in second pile segment |
| 55 | interlocking unit |
| 60 | building slab |
| 70 | bottom of slab |
| 80 | upper portion of wood piling |
| 85 | cut portion of wood piling |
| 90 | excavated space under building slab |
| 100 | top of soil |
| 105 | soil |
| 110 | lower portion of wood piling |
| 115 | top portion |
| 116 | longitudinal bore |
| 120 | saw |
| 130 | drill |
| 135 | arrow |
| 140 | arrow |
| 150 | jack |
| 151 | raised portion of jack |
| 160 | arrows |
| 170 | pile cap |
| 180 | block |
| 181 | shim |
| 182 | small shim |
| 185 | block |
| 186 | shim |
| 187 | small shim |
| 190 | backfill |
| 300 | hydraulic jacks |
| 310 | control panel for hydraulic jacks |
| 320 | hydraulic lifting system |
| 400 | recessed space |
| 410 | upper nut |
| 420 | upper washer |
| 430 | rod |
| 430A | rod |
| 440 | lower washer |
| 450 | lower nut |
| 450A | lower nut |
| 460 | lower tip of rod |
| 470 | longitudinal space through pile segment |

All measurements disclosed herein are at standard temperature and pressure, at sea level on Earth, unless indicated otherwise. All materials used or intended to be used in a human being are biocompatible, unless indicated otherwise.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims.

The foregoing embodiments are presented by way of example only; the scope of the present invention is to be limited only by the following claims.

The invention claimed is:

1. A process of leveling a structure by installing interlocked segmented underpinning piles for supporting the structure upon the earth comprising the steps of:

(a) driving a first pile segment into unexcavated earth a desired distance from the structure, the first pile segment comprising upper and lower portions and having:

(i) a first recessed space being located in the upper portion of the first pile segment and including a bottom;

(ii) the upper portion of the first pile segment surrounding the first recessed space being substantially flat;

(iii) the lower portion of the first pile segment also being substantially flat;

(iv) a first longitudinal passage extending from the bottom of the first recessed space to the lower portion of the first pile segment;

(v) a first threaded rod having upper and lower portions, the upper portion at least partially protruding from the bottom of the first recessed space and the lower portion at least partially protruding from the lower portion of the first pile segment;

(vi) a first upper washer located on the upper portion of the first threaded rod;

(vii) a first upper nut threadably engaging the upper portion of the first threaded rod, wherein the first upper washer is located below the first upper nut;

(viii) a first lower washer located on the lower portion of the first threaded rod;

(ix) a first lower nut threadably engaging the lower portion of the first threaded rod, wherein the first lower washer is located above the first lower nut and below the lower portion of the first pile segment; and (x) the first upper nut, first upper washer, first lower nut, and first lower washer attaching the first threaded rod to the first pile segment;

(b) interlocking a second pile segment with the first pile segment, the second pile segment comprising upper and lower portions and having:

(i) a second recessed space being located in the upper portion of the second pile segment and including a bottom;

(ii) the upper portion of the second pile segment surrounding the second recessed space being substantially flat;

(iii) the lower portion of the second pile segment also being substantially flat;

(iv) a second longitudinal passage extending from the bottom of the second recessed space to the lower portion of the second pile segment;

(v) a second threaded rod having upper and lower portions, the upper portion at least partially protruding from the bottom of the second recessed space and the lower portion at least partially protruding from the lower portion of the second pile segment;

(vi) a second upper washer located on the upper portion of the second threaded rod;

(vii) a second upper nut threadably engaging the upper portion of the second threaded rod, wherein the second upper washer is located below the second upper nut;

(viii) a second lower washer located on the lower portion of the second threaded rod;

(ix) a second lower nut threadably engaging the lower portion of the second threaded rod, wherein the second lower washer is located above the second lower nut and below the lower portion of the second pile segment; and (x) the second upper nut, second upper washer, second lower nut, and second lower washer attaching the second threaded rod to the second pile segment;

wherein the lower portion of the second threaded rod threadably engaging the first upper nut on the first pile segment thereby interlocking the first and second pile segments;

(c) driving the second pile segment a second desired distance into the earth.

2. The process of claim 1, further comprising the steps of:

(d) positioning a cap member between the structure and the second pile segment; and (e) affixing a support member on a side of the cap member opposite the pile segments, the support member for abutment with the structure.

3. The process of claim 1, further comprising the steps of:

(d) removing a volume of earth from beneath a portion of the structure;

(e) positioning the first pile segment below the portion of the structure; and (f) placing a jack between the first pile segment and the portion of the structure.

4. The process of claim 1, wherein in step "a" the first pile segment has a circular cross section between about 6 and 14 inches.

5. The process of claim 1, further comprising the steps of:

(d) removing a volume of earth from beneath a portion of the structure and exposing a portion of a wooden piling;

(e) removing an upper section of the wood piling;

(f) positioning the first pile segment on top of a lower section of the wood piling; and (g) placing a jack between the first pile segment and the portion of the structure.

6. The process of claim 1, wherein in step "a" there is a gap between the first longitudinal passage and the first threaded rod.

7. The process of claim 6, wherein in step "b" there is a gap between the second longitudinal passage and the second threaded rod.

8. The process of claim 1, wherein the upper portion of the first pile segment directly touches the lower portion of the second pile segment.

9. The process of claim 1, wherein the first and second recessed spaces have circular cross sections.

10. The process of claim 1, wherein the first and second threaded rods are threaded from their upper to lower portions.

11. The process of claim 1, wherein the cumulative heights of the first upper washer, first upper nut, second lower nut, and second lower washer are substantially equal to the height of the first recessed space.

12. The process of claim 1, wherein in step "c" a control unit is used for operating a series of hydraulic jacks which simultaneously drive both the second pile segment and a third pile segment, the third pile segment being located in a different interlocked segmented underpinning pile in relation to the interlocked segmented underpinning pile containing the second pile segment.

13. The process of claim 12, wherein the control system minimizes the risk that the structure being leveled will crack due to differential forces created by the series of jacks.

14. The process of claim 12, wherein numerous segmented underpinning piles are simultaneously pushed into the earth.

* * * * *